US008408938B2

(12) United States Patent
Proeckl

(10) Patent No.: US 8,408,938 B2
(45) Date of Patent: Apr. 2, 2013

(54) ELECTRIC PLUG-IN CONNECTOR WITH A UNION NUT

(75) Inventor: Thomas Proeckl, Bad Aibling (DE)

(73) Assignee: Spinner GmbH, Munich (DE)

( * ) Notice: Subject to any disclaimer, the term of this patent is extended or adjusted under 35 U.S.C. 154(b) by 0 days.

(21) Appl. No.: 13/240,696

(22) Filed: Sep. 22, 2011

(65) Prior Publication Data

US 2012/0077368 A1 Mar. 29, 2012

(30) Foreign Application Priority Data

Sep. 23, 2010 (DE) ..... 10 2010 046 410

(51) Int. Cl.
*H01R 13/662* (2006.01)

(52) U.S. Cl. ..... 439/439

(58) Field of Classification Search ..... 439/439, 439/445, 578, 584; 411/4; 85/61
See application file for complete search history.

(56) References Cited

U.S. PATENT DOCUMENTS 4,144,796 A 3/1979 Richter et al.
4,836,727 A 6/1989 Volkmann
4,857,021 A * 8/1989 Boliver et al. ..... 439/801
5,352,134 A * 10/1994 Jacobsen et al. ..... 439/584
6,557,900 B1 * 5/2003 Austin ..... 285/92
6,951,481 B2 * 10/2005 Dykstra et al. ..... 439/578
7,661,984 B2 * 2/2010 McMullen et al. ..... 439/583
7,972,176 B2 * 7/2011 Burris et al. ..... 439/584
8,062,063 B2 * 11/2011 Malloy et al. ..... 439/578
8,062,064 B2 * 11/2011 Rodrigues et al. ..... 439/578
8,070,504 B2 * 12/2011 Amidon et al. ..... 439/321
8,235,741 B2 8/2012 Schulze et al.
8,235,751 B2 * 8/2012 Amidon et al. ..... 439/578

* cited by examiner

*Primary Examiner* — Alexander Gilman
(74) *Attorney, Agent, or Firm* — Edell, Shapiro & Finnan, LLC

(57) ABSTRACT

An electric plug-in connector, comprising a plug head on which a union nut is rotatably disposed for screwing the plug-in connector together with a mating connector, can be screwed together with the mating connector under adherence to a prescribed tightening torque even without a torque wrench if the union nut consists of a threaded sleeve with a ring which comes into engagement with the threaded sleeve by way of driving parts at least during screwing on, of which the one driving part is dimensioned in such a way that it is shorn off by the other driving part when exceeding a tightening torque.

20 Claims, 4 Drawing Sheets

ELECTRIC PLUG-IN CONNECTOR WITH A UNION NUT

CROSS REFERENCE TO RELATED APPLICATIONS

This application claims foreign priority under 35 U.S.C. §119(a)-(d) to Application No. DE 102010046410.4 filed on 23 Sep. 2010, entitled "An Electric Plug-In Connector with a Union Nut," the entire contents of which are hereby incorporated by reference.

FIELD OF THE INVENTION

The invention relates to an electric plug-in connector, comprising a plug head on which a union nut is rotatably disposed for screwing the plug-in connector together with a mating connector.

BACKGROUND

Conventional, electric, plug-in connectors are used in commercial fields such as mobile-phone installations. To mount the plug-in connector, the tightening torque with which the union nut is screwed together with the mating connector must lie within a predetermined tolerance range so that a secure electric contact is ensured and mechanical overloading of the structural parts of the plug-in connector and the mating connector is avoided. For this purpose, the union nut has wrench flats for the application of a torque wrench. The question whether the required tightening torque was maintained during mounting or whether a torque wrench was used at all cannot be verified subsequently.

Thus, it would be desirable to provide an electric plug-in connector that can be mounted without a torque wrench.

SUMMARY

An electric plug-in connector includes a plug head on which a union nut is rotatably disposed for fastening the plug-in connector together with a mating connector. The plug head may be fastened together with the mating connector under adherence to a prescribed tightening torque even without a torque wrench if the union nut includes of a threaded sleeve with a ring which comes into engagement with the threaded sleeve by way of driving parts at least during threaded engagement, of which the one driving part is dimensioned in such a way that it is shorn off by the other driving part when exceeding a tightening torque (i.e., when the amount of applied torque exceeds a predetermined threshold value).

BRIEF DESCRIPTION OF THE DRAWINGS

Like reference numerals have been used to identify like elements throughout this disclosure.

DETAILED DESCRIPTION

The present invention is directed toward an electric plug-in connector that can be mounted without a torque wrench, i.e., with a normal fork wrench for example, by maintaining the required tightening torque. This is achieved in accordance with the invention such a way that the union nut consists of a threaded sleeve and a ring each including at least one driving part. These driving parts come into engagement with one another (at least when the plug-in connector threadingly engages the mating connector). One of the driving parts is dimensioned such that, when the tightening torque applied to the ring is exceeded, one driving part is shorn off by the other driving part.

The plug-in connector can also be mounted at least once by unskilled staff and with normal tools without falling below or exceeding the required tightening torque range, because the shearing off of the driving part will be noticeable to the technician as a sudden decrease in the tightening torque. Additionally, markings can be applied to the threaded sleeve and the ring, on which the twisting of the ring in relation to the threaded sleeve following the shearing off can be recognized.

In one preferred embodiment, the ring is rotatably disposed on the plug head, namely on its side facing away from the mating connector, which means it is therefore disposed axially "behind" the threaded sleeve, adjacent to its face surface on the cable side. The ring can comprise wrench flats, i.e. it can be arranged on the circumference as a hexagon for the same wrench width which is in use for the respective plug-in connector according to the state of the art.

Alternatively, the ring can rotatably be held on the threaded sleeve and can comprise respective wrench flats. This embodiment, in which the drivers are aligned in a radial manner, comes with the advantage that it is arranged shorter in the axial direction then in the above embodiment, but requires the use of a wrench with a larger wrench size across flats as compared with the former.

In the present application, the term "rotatable" shall mean in the two embodiments a rotating capability around a rotational angle which is limited by the drivers.

Figure 1:
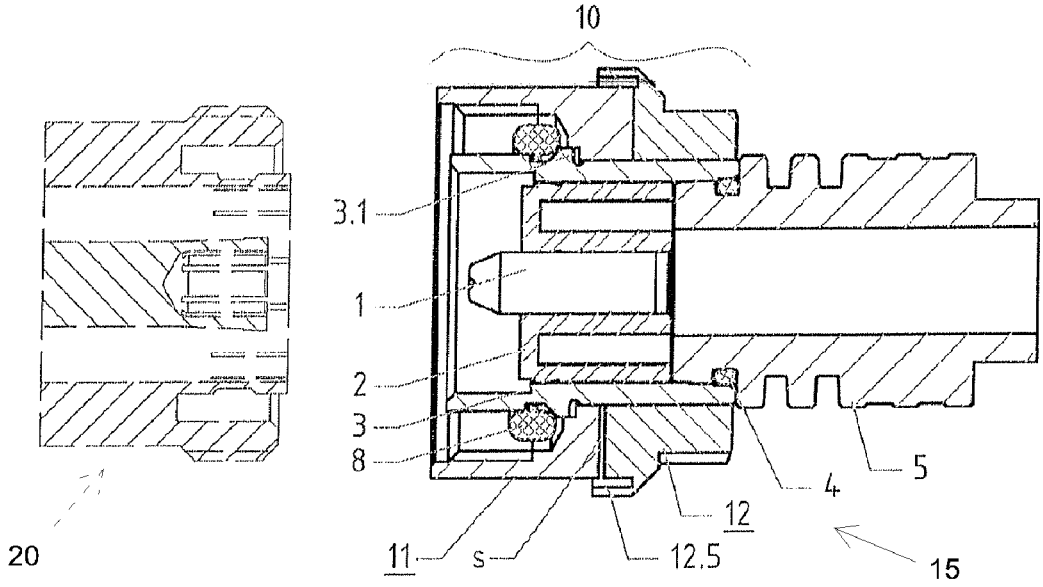
FIG. 1 shows a first embodiment of the plug-in connector in a longitudinal sectional view.
Figure 2:
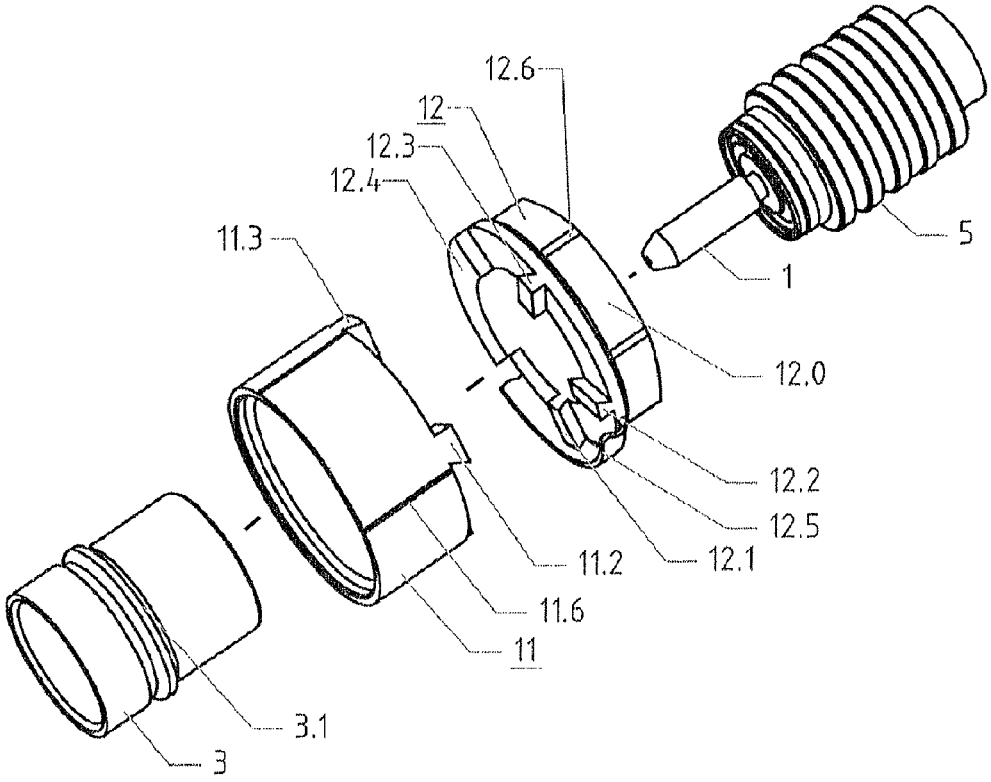
FIG. 2 shows a perspective exploded view of the plug-in connector in FIG. 1.

FIGS. 1 and 2 illustrate a plug-in connector 15 in accordance with an embodiment of the invention. As shown, the coaxial plug-in connector (e.g., a widespread type 7-16 connector) includes an internal plug conductor 1 in an insulating material support 2, which on its part is held in a plug head 3 that forms the external plug conductor. A cable clamping part 5 is screwed together with the plug head 3 by interposing an O-ring 4, which cable clamping part is arranged for connection with an external conductor of a coaxial cable (not shown) whose internal conductor is connected with the internal plug conductor 1, e.g., it is soldered into the same.

A mating plug-in connector 20, which is of the same type and is a so-called housing coupler, for example, is shown by way of a broken line. A union nut 10 is rotatably disposed on the plug head 3 of the plug-in connector 15 for screwing together (i.e., for providing threaded engagement) with the indicated external thread of the mating plug-in connector 20 for producing an electrically and mechanically perfect and durable connection with the mating plug-in connector. The union nut 10 is divided in accordance with the invention into a threaded sleeve 11 and a ring 12. An O-ring 8 is disposed for sealing purposes on the jacket surface of the plug head 3. The plug head 3 comprises on the cable side a circumferential shoulder 3.1 adjacent to said O-ring. The threaded sleeve 11 rests on the O-ring 8 with an annularly circumferential diametric step when being screwed onto the mating plug-in connector.

For the purpose of rotating the threaded sleeve 11, the ring 12 comes into non-positive engagement with said threaded sleeve in the axial direction. The ring 12 includes wrench flats 12.0 for applying a normal fork wrench. In the case of plug-in connectors of very small diameter, the ring 12 can be extended instead in the axial direction and can comprise a straight knurling instead of the wrench flats for example which enable a rotation of the ring 12 by hand. In the case of plug-in connectors of a very large diameter, the ring 12 can be arranged for applying a pin spanner for example.

As is shown in FIGS. 2 and 3, the threaded sleeve 11 includes one or more axially-directed driving parts 11.1-11.3 (called shearing driving parts) distributed over the sleeve circumference. In addition, the ring 12 comprises one or more corresponding driving parts 12.1-12.3 (called shearable driving parts) for producing the non-positive connection with the ring 12. The height of the driving parts 12.1-12.3 on the ring, as measured in the axial direction, may be lower than the axial height of the driving parts 11.1-11.3 disposed on the sleeve. FIG. 1 shows a driving part at the top such as 11.1 in FIG. 2. At the bottom of FIG. 1, the gap between the mutually facing face sides of the threaded sleeve 11 and the ring 12, which is produced by the aforementioned different heights of the driving parts 11.1-11.3, 12.1-12.3, is designated with reference numeral s.

The shearable driving parts 12.1-12.3 of the ring 12 are dimensioned in such a way that they are shorn off by the respectively engaged shearing driving parts 11.1-11.3 of the threaded sleeve 11 upon reaching a predetermined tightening torque specified for the plug-in connector. In the illustrated embodiment, the ring 12 comprises three such shearable driving parts such as 12.1-12.3, which are arranged to be distributed over the circumference of the face surface of the ring 12 (as will be explained below in closer detail) in such a way that, after the shearing off of a first shearable driving part 12.1 via engagement with a corresponding first shearing driving part 11.1, and a release and renewed screwing of the plug-in connector 15 onto the mating plug-in connector 20, the respectively next shearable driving part of the ring 12 (e.g., a second shearable driving part 12.2) will come into engagement with a corresponding shearing driving part of the threaded sleeve 11 (e.g., a second shearing driving part 11.2) causing shearing off, and is shorn off again with the predetermined torque.

The gap s, by means of which the distance between the face surfaces of the threaded sleeve 11 and the ring 12 is larger than the height of the driving parts (e.g., 12.1), ensures that shorn driving parts will not get wedged between these face surfaces or are able to be placed directly in front of a driving part not yet shorn off. It is thereby prevented that a shorn driving part will increase the torque required for the renewed screwing of the plug-in connector onto the mating plug-in connector for shearing the next driving part beyond the predetermined value.

In order to prevent that shorn driving parts will fall out of the space between the face surfaces of the threaded sleeve 11 and the ring 12, the ring may further include a ring apron 12.5 (shown in FIG. 2 in a manner that is partly broken away). As shown, the ring apron 12.5 produces an outwardly enclosed cutting cage between the spaced face surfaces of the threaded sleeve 11 and the ring 12.

In order to make the locations and the numbers of the shearable driving parts 12.1.-12.3 recognizable on the circumference of the ring 12 and their relative position to the shearing driving parts 11.1-11.3 of the threaded sleeve 11, both the ring 12 and the threaded sleeve 11 may be provided with suitable markings 12.6 and 11.6, respectively. As a result, reaching the predetermined tightening torque when screwing the plug-in connector 15 onto the mating plug-in connector 20 will be indicated both by the rise in the force to be exerted on the tool and its sudden decrease after shearing off the respective shearable driving part 12.1-12.3 in a perceivable manner, and also in a visual manner by the simultaneous relative twisting of the respective markings 11.6, 12.6 relative to one another.

In order to release the threaded connection independent of the number of driving parts that have already been shorn off, the ring 12 comprises a massive segment or flange 12.4, which, during the release, comes into engagement with one of the driving parts (e.g., 11.1).

Figure 3A:
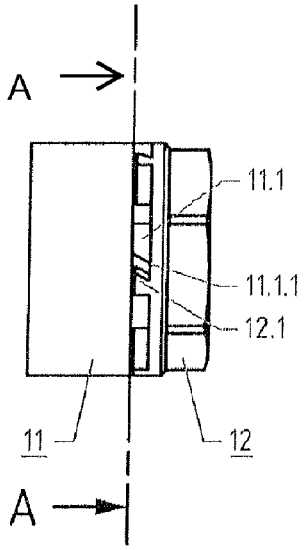
FIG. 3*a* shows a side view of the two-part union nut in FIG. 1.
Figure 3B:
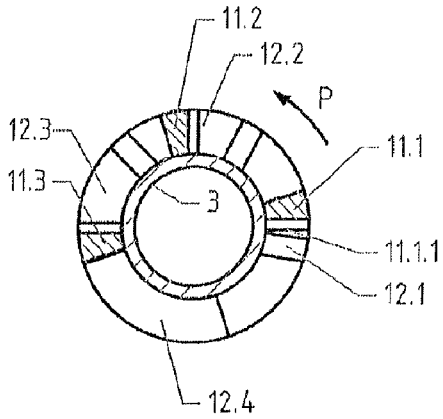
FIG. 3*b* shows a sectional view along the line A-A of FIG. 3*a;*

By omitting the remaining parts of the plug-in connector, FIGS. 3*a* and 3*b* show the relative position of the threaded sleeve 11 and the ring 12 shortly before reaching the position in which the first shearable driving part 12.1 of the ring 12 comes into positive engagement with the first shearing driving part 11.1 of the threaded sleeve 11. In the illustrated embodiment, the threaded sleeve 11 has three such driving parts (i.e., the first shearing driving part 11.1, a second shearing driving part 11.2, and a third shearing driving part 11.3), which each acts in a shearing capacity. As further shown in the illustrated embodiment, the ring 12 has three corresponding shearable driving parts (the first shearable driving part 12.1, a second shearable driving part 12.2, and a third shearable driving part 12.3), which are arranged to be offset by different angles over the circumference of the ring 12.

Figure 4A:
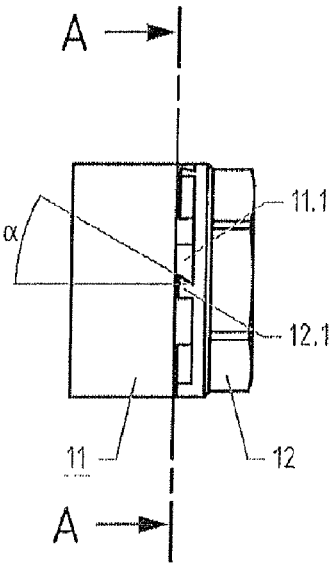
FIGS. 4*a*, 4*b* show a side view and a sectional view as in FIGS. 3*a*, and 3*b*, but after rotation of the ring about approx. 5 degrees relative to the threaded sleeve.

The flanks of all driving parts which come into non-positive engagement during the rotation of the ring 12 in the direction of arrow P in FIG. 3*b* (according to a right-hand thread), which are the flanks of the driving parts 11.1 and 12.1 in FIGS. 3*a* and 3*b*, enclose a cutting angle $\alpha$ with the cutting plane, that is the plane containing the face surface of the ring 12, which cutting angle is designated with reference a for the driving parts 11.1 and 12.1 in FIG. 4*a*. This cutting angle $\alpha$ is larger than the frictional angle between the driving parts 11.1 and 12.1. As a result, the ring 12 is pulled in the axial direction towards threaded sleeve 11. That is why the free edge 11.1.1 of the driving part 11.1 acts in FIG. 3*b* as a blade against the base of the driving part 12.1. The cross-section of the shearable driving parts 12.1-12.3 at their base determines the level of the tightening torque of ring 12 required for shearing off. The material for the threaded sleeve 11, its dimensioning and especially the dimension of its driving parts 11.1-11.3 is chosen in such a way that when the screwed joint is tightened and especially during the shearing process there will not be any elastic or even plastic deformations. A brass alloy can be a suitable material for the threaded sleeve 11 and an aluminum alloy with a narrowly tolerated tensile strength can be a suitable material for the ring 12.

Figure 4B:
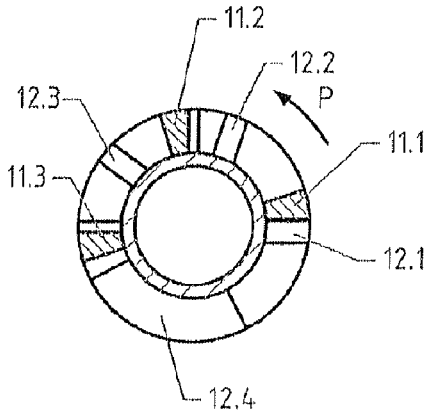

FIGS. 4*a* and 4*b* shows the position of the ring 12 relative to the threaded sleeve 11 after the rotation in the direction of the arrow P in FIG. 3*b* by approximately 5° up to the engagement between the first shearing driving part 11.1 and the first shearable driving part 12.1.

In order to release the threaded joint, the ring 12 is twisted counterclockwise (as shown in the top view in FIG. 4*b* example) until its segment 12.4 comes with its flank into engagement and thereby produces a non-positive engagement with a rear-side flank of the driving part 11.3 of the threaded sleeve 11 and the ring is thereby further rotated. The segment 12.5 therefore ensures that the screwed joint can be released again after shearing off all driving parts 12.1-12.3. That is why the plug-in connector remains useful even after shearing off all shearable driving parts 12.1-12.3. In this case, however, it requires the use of the torque wrench in order to maintain the required tightening torque.

Figure 5A:
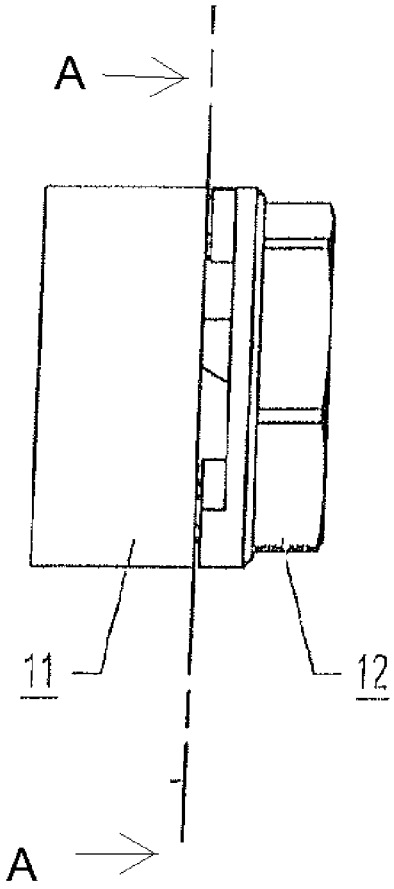
FIGS. 5*a*, 5*b* show an illustration as in FIGS. 3*a* and 3*b*, but after further rotations of the ring relative to the threaded sleeve.
Figure 5B:
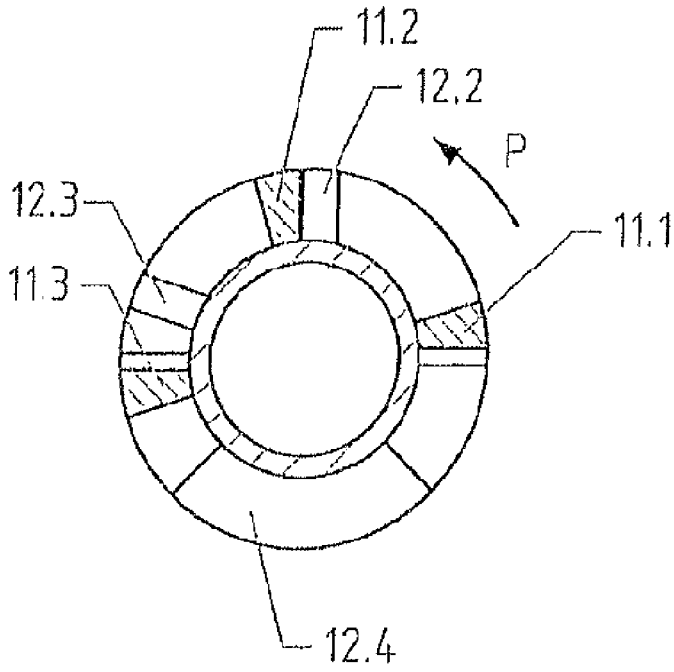

FIGS. 5*a* and 5*b* illustrate the position of the ring 12 relative to the threaded sleeve 11 in the event that the screwed joint of the plug-in connector with the mating connector was released after shearing off the driver 12.1 in FIG. 4*a* and FIG. 4*b*, and subsequently the plug-in connector is to be screwed together again with the same or another mating connector. In the position as illustrated in FIGS. 5*a*, 5*b*, the driving part 12.1 (cf. FIGS. 3*a* to 4*b*) has been shorn off in the course of the first screwing-on (threading engagement) process. The shorn driving part is not shown. The shearable driving part 12.2 has come into non-positive engagement with the shearing driving part 11.2 for the second screwing-on process which progresses like the first screwing-on process. This is followed by the shearing off of the driving part 12.2 under the predetermined tightening torque (not shown). The still shearable driving part 12.3 is available for a third screwing-on process.

Figure 6:
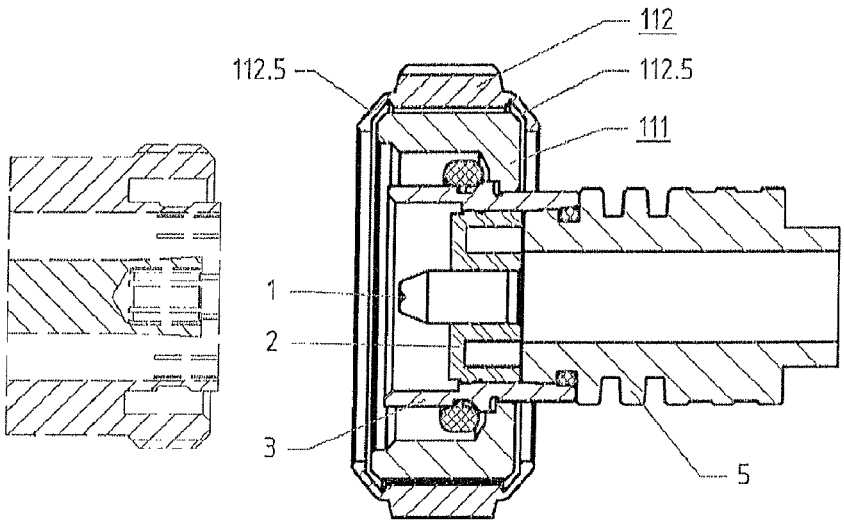
FIG. 6 shows a second embodiment of the plug-in connector in a longitudinal sectional view.
Figure 7:
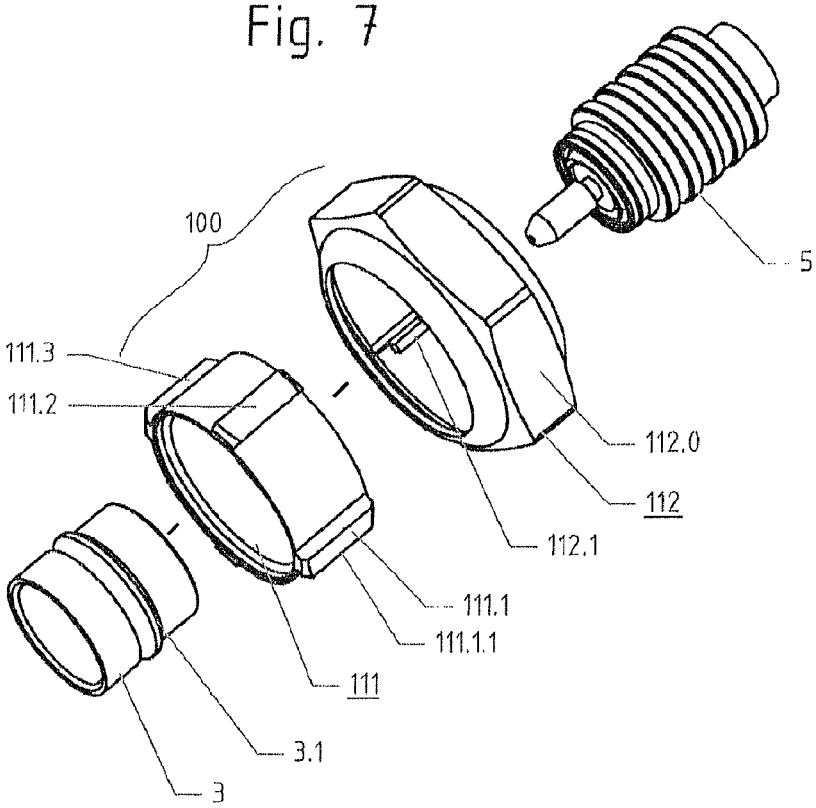
FIG. 7 shows a perspective exploded view of the plug-in connector in FIG. 6.

FIGS. 6 and 7 illustrate in a representation according to FIGS. 1 and 2 a second embodiment of the plug-in connector according to the invention. The plug-in connector in FIGS. 6 and 7 corresponds to the one in FIGS. 1 and 2 with the exception of the union nut. The respective parts therefore have the same reference numerals as in FIGS. 1 and 2. In this embodiment, the union nut 100 is split into two parts not in the axial but in the radial direction, namely into a threaded sleeve 111 and a ring 112 which radially encloses the sleeve. The ring comprises wrench flats 112.0. On its inner circumference, the ring 112 comprises several shearable driving parts such as 112.1 in FIG. 7, which driving parts correspond in respect of their function to the driving parts 12.1, etc. in FIGS. 1-5*b*. Analogously, the threaded sleeve 111 comprises shearing driving parts 111.12, 111.3 in FIG. 7, which are arranged in a distributed manner on its outside circumference and which again correspond to the shearable driving parts 11.1, etc. described in FIGS. 1-5*b* and analogously comprise a blade such as 111.1.1 which acts in a shearing manner. The ring 111 further comprises a massive segment (not shown in this illustration) with the same function as segment 12.4 of the ring 12 shown in FIGS. 1-5*b*.

The "radial" embodiment of the plug-in connector according to FIGS. 6 and 7 is therefore functionally identical with the "axial" embodiment according to FIGS. 1-5*b*. The ring 111 comprises roller-formed ring aprons 112.5 which are spaced from the threaded sleeve 111 and which outwardly delimit the circumferential annular space between the threaded sleeve 111 and the ring 112 in analogy to the ring apron 12.5 in FIGS. 1 and 2 in order to prevent shorn driving parts such as 112.1 from falling out.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

The construction of a union nut 10, 100 as described above, which is screwed onto a mating thread with a prescribed tightening torque without having to use a torque wrench, can also be applied to a cable clamp, i.e. the threaded sleeve with which a coaxial cable makes contact by way of its external conductor with the plug head and is connected in a mechanically non-withdrawable manner. For this purpose, the threaded sleeve is arranged in two parts analogously to the union nut.

The shearable driving part can be in the form of a tooth-like segment and the shearing driving part can consist of a cutting profile with a blade directed against the base of the tooth-like segment. The shearable driving part can be arranged on the ring and the shearing driving part can be arranged accordingly on the threaded sleeve. The reverse allocation is also possible. If the materials of the threaded sleeve and the ring differ from one another, i.e. the threaded sleeve is formed of brass and the ring is formed of an aluminum alloy, it is recommended to arrange the shearable driving part on the part of the divided union nut which consists of the more ductile material, which in this example is the ring made of aluminum.

The threaded sleeve and the ring can each comprise two driving parts which are respectively opposite of one another on the same diameter of the threaded sleeve and the ring. The two shearable driving parts are then dimensioned in such a way that upon reaching the prescribed tightening torque they are simultaneously shorn off by the two shearing driving parts. This comes with the advantage that the shearing forces will act in opposite directions symmetrically to the central axis of the divided union nut.

If the plug-in connector includes only one shearable driving part (or two simultaneously shearable driving parts) in the embodiment as described above, the release of the produced screwed joint and thus a separation of the plug-in connector from its mating connector is only possible by means of a tool acting on the threaded sleeve, but no longer by rotation of the ring. The latter can be achieved such that that the ring comes into a non-positive engagement with the threaded sleeve also during rotation in the direction of the release of the screwed joint. If the shearable driving part is (or the shearable driving parts are) arranged on the ring, for example, the latter can additionally comprise for this purpose a segment with a flank dimensioned with sufficient strength, against which a rear flank (facing away from the blade) of the shearing driving part comes to rest and thereby produces the non-positive connection with the threaded sleeve. After the release, the plug-in connector can again be coupled and screwed together with the same or another mating connector, but only by means of a torque wrench.

One embodiment which allows the repeated production and release of the screwed joint of the plug-in connector with the (or any other) mating connector without torque wrench is that several shearable driving parts are arranged in an angularly offset manner, with which a single shearing driving part comes into engagement successively during every renewed screwing. Since it needs to be ensured in this embodiment that the ring, as indicated above, comes into non-positive engagement with the threaded sleeve during rotation in the direction of the release of the screwed joint, the plug-in connector can be screwed together with the mating connector, be detached from the same and be screwed together with the same again under adherence to the predetermined tightening torque as often as there are shearable driving parts. Although the plug-in connector remains useful even after shearing off all shearable driving parts, the use of a torque wrench will then be necessary for all further screwed joints with the mating connector, as is the case with the usual conventional plug-in connectors with integral union nut.

Instead, the threaded sleeve and the ring can each comprise further driving parts in accordance with a further embodiment, which driving parts are associated with each other in pairs and are arranged to be distributed in an offset manner over the circumference of the threaded sleeve in such a way that after the release of the screwed joint and renewed screwing together the driving part that follows next after the shorn driving part in the rotational direction will be shorn off. As a result of this allocation in pairs, a chamber-like gap for accommodating the respectively shorn driving part is produced from shearing driving part to shearing driving part. It is prevented thereby that a shorn driving part will obstruct the shearing off of the next following driving part for example, so that a higher tightening torque than the predetermined one would have to be applied for shearing it off. It can additionally be achieved by an offset of the shearable driving parts by different circumferential angles for example that in the production of the plug-in connector the threaded sleeve and the ring can only be mounted in one predetermined relative position which determines which of the shearable driving parts is shorn off as the first one.

Preferably, the height of the shearable driving part, depending on the axial or radial direction as measured according to the embodiment, is smaller than the height of the shearing driving part. The difference is dimensioned in such a way that a shorn driving part is unable to get wedged in the gap space between the threaded sleeve and the ring.

In a preferred embodiment, the surfaces or flanks of the driving parts which come into engagement with each other when unscrewing the threaded sleeve by means of the ring and the subsequent shearing off enclose an effective cutting angle with a plane which is at a right angle to the cutting or shearing plane. This effective cutting angle ensures that the ring is drawn against the threaded sleeve, in the axial or in the radial direction depending on the embodiment. As a result, the shearing force is predominantly directed against the base region of the shearable driving part, thus promoting the reproducibility of the shearing force and thus maintaining a narrow tolerance range of the tightening torque. Moreover, it is achieved by shearing off the respective driving part at the level of its base that the ring remains freely rotatable in relation to the threaded sleeve within the predetermined angular range for the release and optionally for repeating the screwed joint, i.e. no friction occurs between the face surface of a shearing driving part and a remainder of an already shorn driving part.

Both effects of the effective cutting angle are especially ensured when the effective cutting angle is larger than the frictional angle of the driving parts which are in engagement with each other.

If it needs to be prevented that a shorn driving part falls out of the plug-in connector from a large height such as an aerial mast or drops between other functional parts in a switch cabinet, the entire gap-like space between the threaded sleeve and the ring can be sealed towards the outside by a cutting cage. In the axial embodiment, the cutting cage can consist of an annular jacket which is arranged to be integral with the threaded sleeve or the ring for example and bridges the intermediate space. In the radial embodiment, it can consist of annular stops on the two face surfaces in form of roller-formed flange rings.

If there are several shearable driving parts for repeated screw joints of the plug-in connector with the mating connector, the threaded sleeve and the ring are appropriately provided with markings which display the number of the yet still available screw joints without a torque wrench.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. An electric plug-in connector comprising:

a plug head; and a union nut rotatably disposed on the plug head, the union nut configured to threadingly engage the plug-in connector with a mating connector, the union nut comprising:

a threaded sleeve including a shearing driving part, and a ring including a shearable driving part comprising a tooth-shaped segment, the shearing driving part on the ring further comprising a cutting profile with a blade directed against the base of the tooth-shaped segment, wherein the ring engages the threaded sleeve via the driving parts, and wherein the shearable driving part disposed on the ring is dimensioned such that it is shorn off by the shearing driving part disposed on the sleeve upon application of a predetermined torque amount to the ring, the applied torque amount exceeding a predetermined threshold value.

2. The plug-in connector according to claim 1, wherein the ring is rotatably held on the plug head along a side facing away from the mating connector.

3. The plug-in connector according to claim 1, wherein the ring is rotatably connected to the threaded sleeve.

4. The plug-in connector according to claim 1, wherein the threaded sleeve and the ring each comprises two driving parts disposed opposite one another on the same diameter of the threaded sleeve and the ring.

5. The plug-in connector according to claim 1, wherein the ring comes into non-positive engagement with the threaded sleeve upon rotation in direction of the release of the screwed joint.

6. The plug-in connector according to claim 1, wherein the ring comprises a plurality of shearable driving parts arranged in an angularly offset manner about the ring.

7. The plug-in connector according to claim 1, wherein:

the threaded sleeve comprises a plurality of shearing driving parts, the shearing driving parts arranged to be offset over the circumference of the threaded sleeve;

the ring comprises a plurality of shearable driving parts, each shearable driving part associated with a corresponding sleeve driving part, the shearable ring driving parts being arranged to be offset over the circumference of the ring; and the driving parts are positioned such that, after a release of the fastened joint and renewed fastening together, a shearable driving part adjacent a shorn-off driving part in the rotational direction is shorn off.

8. The plug-in connector according to claim 1, wherein the height of the shearable driving part on the ring is less than the height of the shearing driving part on the threaded sleeve.

9. The plug-in connector according to claim 1, wherein surfaces of the shearing and shearable driving parts, which come into engagement with each other during the threaded mating of the threaded sleeve and subsequent shearing, cooperate to define a cutting angle $\alpha$ with a plane oriented at a right angle to the cutting plane.

10. The plug-in connector according to claim 9, wherein the cutting angle $\alpha$ is larger than a frictional angle of the shearing and shearable driving parts that are in engagement with each other.

11. The plug-in connector according to claim 1, wherein:

the shearable driving parts on the ring are disposed within a space defined by the threaded sleeve and the ring; and the space is externally enclosed by a cutting cage.

12. The plug-in connector according to claim 1, wherein the position of the shearable driving part relative to the position of the shearing driving part is designated with a visible marking.

13. An electric plug-in connector comprising:

a plug head; and a union nut rotatably disposed on the plug head, the union nut configured to threadingly engage the plug-in connector with a mating connector, the union nut comprising:

a threaded sleeve including a shearing driving part, and a ring including a shearable driving part, the ring engaging the threaded sleeve via the driving parts, wherein the shearable driving part disposed on the ring is dimensioned such that it is shorn off by the shearing driving part disposed on the sleeve upon application of a predetermined torque amount to the ring, the applied torque amount exceeding a predetermined threshold value, and wherein surfaces of the shearing and shearable driving parts, which come into engagement with each other during the threaded mating of the threaded sleeve and subsequent shearing, cooperate to define a cutting angle $\alpha$ with a plane oriented at a right angle to the cutting plane.

14. The plug-in connector according to claim 13, wherein the ring is rotatably held on the plug head along a side facing away from the mating connector.

15. The plug-in connector according to claim 13, wherein the ring is rotatably connected to the threaded sleeve.

16. The plug-in connector according to claim 13, wherein the threaded sleeve and the ring each comprise two driving parts disposed opposite of one another on the same diameter of the threaded sleeve and the ring.

17. The plug-in connector according to claim 13, wherein the ring comes into non-positive engagement with the threaded sleeve upon rotation in direction of the release of the screwed joint.

18. The plug-in connector according to claim 13, wherein the ring comprises a plurality of shearable driving parts arranged in an angularly offset manner about the ring.

19. The plug-in connector according to claim 13, wherein the threaded and the ring each comprises $n \geqq 2$ driving parts which are associated with each other in pairs and the shearable driving parts are arranged to be offset over the circumference of the threaded sleeve and the ring in such a way that after a release of the screwed joint and renewed screwing together the driving part which follows next after a shorn-off driving part in the rotational direction is shorn off.

20. The plug-in connector according to claim 13, wherein the cutting angle $\alpha$ is larger than a frictional angle of the shearing and shearable driving parts that are in engagement with each other.

* * * * *